US006819044B2

(12) United States Patent
Shirakawa et al.

(10) Patent No.: US 6,819,044 B2
(45) Date of Patent: Nov. 16, 2004

(54) THIN-FILM EL DEVICE AND COMPOSITE SUBSTRATE

(75) Inventors: Yukihiko Shirakawa, Tokyo (JP); Masatoshi Takizawa, Tokyo (JP); Minoru Ookoba, Tokyo (JP); Shirou Ootsuki, Tokyo (JP)

(73) Assignee: TDK Corporation, Tokyo (JP)

( * ) Notice: Subject to any disclaimer, the term of this patent is extended or adjusted under 35 U.S.C. 154(b) by 7 days.

(21) Appl. No.: 10/409,106

(22) Filed: Apr. 9, 2003

(65) Prior Publication Data

US 2003/0193289 A1 Oct. 16, 2003

(30) Foreign Application Priority Data

Apr. 10, 2002 (JP) ..... 2002-107562

(51) Int. Cl.[7] ..... H01J 1/62

(52) U.S. Cl. ..... 313/506; 313/498

(58) Field of Search ..... 313/498, 503, 313/506, 509, 512

(56) References Cited

FOREIGN PATENT DOCUMENTS

| | | |
|---|---|---|
| JP | 7-50197 | 2/1995 |
| JP | 7-44072 | 5/1995 |

OTHER PUBLICATIONS

Shosaku Tanaka, "Recent Development of inorganic and Organic EL Display", Monthly Magazine Display, Apr. 1998, pp. 1–10.

X. Wu, "Multicolor Thin–Film Ceramic Hybrid EL Displays", International Display Workshop (IDW), 1997, pp. 593–596.

*Primary Examiner*—Vip Patel

(74) *Attorney, Agent, or Firm*—Oblon, Spivak, McClelland, Maier & Neustadt, P.C.

(57) ABSTRACT

A thin-film EL device includes a lower electrode layer, a barrier layer containing a conductive inorganic compound, a lower insulating layer, a light emitting layer, and an upper electrode layer stacked in order on an electrically insulating substrate. An EL device of high display quality is established at a low cost by acquiring satisfactory light emitting properties without using an expensive high-melting point noble metal in the lower electrode layer and without increasing the thickness of the lower electrode layer, even when the lower insulating layer contains a lead base dielectric material.

6 Claims, 1 Drawing Sheet

THIN-FILM EL DEVICE AND COMPOSITE SUBSTRATE

TECHNICAL FIELD

This invention relates to a thin-film EL device having at least a structure comprising a lower electrode layer having a predetermined pattern, a lower insulating layer, a light emitting layer, and an upper electrode layer of a transparent conductive material stacked on an electrically insulating substrate. It also relates to a composite substrate for use in thin-film EL devices and various other display devices.

BACKGROUND ART

EL devices are on commercial use as backlight in liquid crystal displays (LCD) and watches.

The EL devices utilize the phenomenon that a material emits light upon application of an electric field, known as electroluminescent phenomenon.

The EL devices using inorganic phosphors include dispersion type EL devices of the structure that a dispersion of powder phosphor in organic material or enamel is sandwiched between electrode layers, and thin-film type EL devices in which a light emitting thin film sandwiched between a pair of insulating thin films and further between a pair of electrode layers is disposed on an electrically insulating substrate. For each type, the drive modes include DC voltage drive mode and AC voltage drive mode. The dispersion type EL devices are known from the past and have the advantage of easy manufacture, but their use is limited because of a low luminance and a short lifetime. On the other hand, the thin-film EL devices are currently on widespread use on account of a high luminance and a long lifetime.

FIG. 2 shows the structure of a dual insulated thin-film EL device as a typical prior art EL device. This thin-film EL device has a structure comprising a lower electrode layer 3, a lower insulating layer 4, a light emitting layer 5, an upper insulating layer 6, and an upper electrode layer 7 stacked on an electrically insulating substrate 2. The substrate 2 is transparent and constructed, for example, of a soda-lime glass customarily used in liquid crystal displays and plasma display panels (PDP). The lower electrode layer 3 is a layer of indium tin oxide (ITO) having a thickness of about 0.2 to 1 $\mu$m. The lower and upper insulating layers 4 and 6 are thin films deposited by sputtering, evaporation or the like to a thickness of about 0.1 to 1 $\mu$m and usually formed of $Y_2O_3$, $Ta_2O_5$, $Al_3N_4$, $BaTiO_3$ or the like. The light emitting layer 5 has a thickness of about 0.2 to 1 $\mu$m. The upper electrode layer 7 is formed of a metal such as Al. The lower and upper electrode layers 3 and 7 are patterned into orthogonally extending stripes so that they constitute column and row electrodes, respectively. In this electrode matrix, the intersections between column and row electrodes make pixels. The matrix electrodes are controlled to apply an AC voltage or pulse voltage to a selected pixel whereby the light-emitting material at that site emits light which comes out from the substrate 2 side.

In this thin-film EL device, the lower and upper insulating layers 4 and 6 have a function of restricting the current flow through the light emitting layer 5 in order to restrain breakdown of the thin-film EL device and act so as to provide stable light-emitting properties. Thus thin-film EL devices of this structure find widespread commercial use.

Among phosphor materials of which the light-emitting layer 5 is made, Mn-doped ZnS exhibiting yellowish orange light emission has mainly been used for ease of film formation and light-emitting properties. For color display fabrication, it is inevitable to use light-emitting materials capable of emitting light in the three primary colors, red, green and blue. These materials known so far in the art, for instance, include Ce-doped SrS and Tm-doped ZnS exhibiting blue light emission, Sm-doped ZnS and Eu-doped CaS exhibiting red light emission, and Tb-doped ZnS and Ce-doped CaS exhibiting green light emission.

Shosaku Tanaka, "the Latest Development in Displays" in Monthly Display, April, 1998, pp. 1–10, discloses ZnS, Mn/CdSSe, etc. as red light-emitting materials, ZnS:TbOF, ZnS:Tb, etc. as green light-emitting materials, and SrS:Cr, $(SrS:Ce/ZnS)_n$, $CaGa_2S_4$:Ce, $SrGa_2S_4$:Ce, etc. as blue light-emitting materials. Such light-emitting materials as SrS:Ce/ZnS:Mn are also disclosed as white light-emitting materials.

International Display Workshop (IDW), 1997, X. Wu, "Multicolor Thin-Film Ceramic Hybrid EL Displays", pp. 593–596 discloses that among the aforesaid materials, SrS:Ce is used as a blue light-emitting layer in a thin-film EL device. In addition, this article discloses that when a light-emitting layer of SrS:Ce is formed, an electron beam evaporation process in a $H_2S$ atmosphere enables to form a light-emitting layer of high purity.

However, for these thin-film EL devices, a structural problem remains unsolved. When a large area display is fabricated, steps appear on the lower insulating layer 4 at the edges of the pattern of the lower electrode layer 3, and dust and debris occurring during the process introduce defects into the lower insulating layer 4. Since the lower insulating layer 4 is a thin film, it is difficult to reduce to nil such steps and defects, resulting in a destruction of the light-emitting layer 5 due to a local dielectric strength drop. These problems are fatal to display devices, and become a bottleneck in the wide practical use of thin-film EL devices in a large-area display system, in contrast to liquid crystal displays or plasma displays.

To provide a solution to the defect problem associated with such thin-film insulating layers, JP-B 07-44072 discloses an EL device using an electrically insulating ceramic substrate as the substrate 2 and a thick-film dielectric layer instead of a thin-film insulating layer as the lower insulating layer 3. Since the EL device of the above patent is constructed such that light emitted by the light emitting layer 5 is extracted from the upper side remote from the substrate 2 as opposed to prior art thin-film EL devices, a transparent electrode layer is used as the upper electrode 7.

Further, in this EL device, the thick-film dielectric layer is formed to a thickness of several tens to several hundreds of microns, which is several hundred to several thousand folds of the thickness of the thin-film insulating layer. This minimizes the potential of breakdown which is otherwise caused by steps in the lower electrode layer 3 and pinholes formed by debris during the manufacturing process, ensuring advantages of high reliability and high manufacturing yields. Meanwhile, the use of such a thick-film dielectric layer entails a problem of reducing the effective voltage applied across the light emitting layer 5. For example, the above-referred JP-B 7-44072 overcomes this problem by constructing the thick-film dielectric layer from a lead-containing complex perovskite high-permittivity material.

However, the light emitting layer formed on the thick-film dielectric layer has a thickness of several hundreds of nanometers which is merely about 1/100 of that of the thick-film dielectric layer. This requires that the thick-film dielectric layer on the surface be smooth at a level below the thickness of the light emitting layer. However, a conventional thick-film procedure is difficult to form a dielectric layer having a fully smooth surface.

Specifically, the thick-film dielectric layer is essentially constructed of a ceramic material obtained by sintering a powder raw material. Intense sintering generally brings about a volume contraction of about 30 to 40%. Unfortunately, although customary ceramics consolidate through three-dimensional volume contraction upon sintering, thick-film ceramics formed on substrates cannot contract in the in-plane directions of the substrate under restraint by the substrate, and is allowed for only one-dimensional volume contraction in the thickness direction. For this reason, sintering of the thick-film dielectric layer proceeds insufficiently, resulting in an essentially porous body. Moreover, since the surface roughness of the thick film is not reduced below the crystal grain size of the polycrystalline sintered body, its surface have asperities greater than the submicron size.

When the thick-film dielectric layer is porous or has surface asperities as mentioned above, it is impossible to deposit thereon a light-emitting layer as a uniform thin film by a vapor phase deposition technique such as evaporation or sputtering because the light-emitting layer cannot conform to the surface morphology of the thick-film dielectric layer. This raises problems such as a decrease in effective light-emitting area because an electric field cannot be effectively applied to the portions of the light-emitting layer formed on non-flat portions of the thick-film dielectric layer, and a decrease in luminance because local non-uniformity of film thickness causes a local dielectric breakdown of the light-emitting layer. Furthermore, locally large thickness fluctuations cause the strength of an electric field applied to the light-emitting layer to locally vary too largely, failing to establish a definite light emission voltage threshold.

To solve these and other problems, for example, JP-A 7-50197 discloses a procedure of improving surface smoothness by stacking on a thick-film dielectric layer of lead niobate a high-permittivity layer of lead titanate zirconate or the like which is formed by the sol-gel technique.

As mentioned above, the use of a high-permittivity thick-film dielectric layer avoids any deficiency in the thin-film insulating layer which is otherwise caused by steps at the edges of the pattern of the lower electrode layer and dust, etc. occurring in the production process, and overcomes the problems that the light-emitting layer can be destructed by a local dielectric strength drop.

For the thick-film dielectric layer, lead base dielectrics are often used in order to acquire such advantages as potential low-temperature sintering, high permittivity and high dielectric strength. On use of lead base dielectrics, however, a sintering temperature of at least 700° C., and most often, at least 800° C. is still needed. Moreover, since the firing of a thick-film dielectric layer is generally carried out in a high-temperature oxidizing atmosphere, the lower electrode layer formed prior to the thick-film dielectric layer should have both heat resistance and oxidation resistance. Also, when the thick-film dielectric layer is formed of a lead base dielectric material, the very high reactivity of lead oxide as one constituent of the dielectric material requires that the material of which the lower electrode layer is made have least reactivity with lead oxide at high temperature, in addition to the normal requirements of heat resistance and oxidation resistance. Since the lower electrode layer is patterned on practical use, the electrode pattern can cause steps to form on the surface of the thick-film dielectric layer if the electrode layer is very thick. This exacerbates the display quality. For this reason, it is preferred that the lower electrode layer be thin. It is thus necessary for the lower electrode layer to be formed of a material capable of providing sufficient conductivity even at a reduced thickness.

A common approach taken in the prior art to meet such property requirements is to use high-melting point noble metals as the material for the lower electrode layer. Among the noble metal electrode materials, Ag is most attractive as a high conductivity, low cost electrode material because it is very low in material cost as compared with the other noble metals including Au, Pt, Pd, Ir, Ru and Rh and has the lowest electrical resistance. However, it is difficult to use Ag alone because Ag has a low melting point and poor heat resistance as compared with the other noble metals. Then Ag is used in the form of alloys such as Ag—Pd and Ag—Pt as disclosed in the above-referred JP-B 7-44072 and JP-A 7-50197, and most often in the form of Ag—Pd alloys having a Pd content of 10 to 70%.

However, since Pd is an extremely expensive noble metal, even Ag—Pd alloys are very expensive as compared with Ag alone. Additionally, Ag-containing noble metal alloy electrode layers such as Ag—Pd alloys and Ag—Pt alloys have very low heat resistance when they are thin. This necessitates to increase the content of high-melting point noble metal such as Pd or Pt to enhance heat resistance, inviting a cost increase. Further, the alloying of Ag with Pd, Pt or the like has the problem that as the content of Pd or Pt increases, the alloy increases its electric resistance and loses its performance as the electrode. In order to form a low-resistance electrode, the thickness of an alloy layer must be increased, which not only increases the amount of material used and hence, the manufacture cost of the electrode to invite a cost increase, but also exacerbates the display quality.

In addition to the problem that Ag is difficult to use alone for the aforementioned reason, another problem arises from the fact that Ag is highly reactive with lead base dielectric materials. Even when Ag is alloyed with other high-melting point noble metals, the Ag component in the electrode can react during firing of lead base dielectric material to incur a substantial increase of electrode resistance and in worst cases, line breakage. It is thus very difficult to use the alloy at a thickness as thin as 1 $\mu$m or less.

Even the use of high-melting point noble metals such as Pt and Pd alone as the electrode is problematic when ceramics such as alumina are used as the substrate. Since the surface of ceramic substrates is not flat, the heat resistance of the electrode layer becomes degraded when the film thickness is less than 1 $\mu$m. This allows the electrode to increase its resistance during the high temperature process involved in the formation of a dielectric layer.

SUMMARY OF THE INVENTION

The present invention addresses a thin-film EL device comprising a lower electrode layer, a lower insulating layer, a light emitting layer, and an upper electrode layer stacked in order on a substrate. An object of the present invention is to provide a thin-film EL device of high display quality at a low cost by acquiring satisfactory light emitting properties without using an expensive high-melting point noble metal in the lower electrode layer and without increasing the thickness of the lower electrode layer, even when the lower insulating layer contains a lead base dielectric material.

According to the present invention, there is provided a thin-film EL device comprising at least a lower electrode layer, a barrier layer containing a conductive inorganic compound, a lower insulating layer, a light emitting layer, and an upper electrode layer stacked in order on an electrically insulating substrate. The conductive inorganic compound is preferably an oxide, more preferably an oxide containing indium and/or tin. The lower electrode layer is preferably a metal electrode containing silver. The lower insulating layer preferably comprises a lead-containing oxide dielectric. The barrier layer preferably has a resistivity of up to 100 Ω·cm and often, at least $10^{-4}$ Ω·cm. The lower electrode layer preferably has a resistivity of up to $2\times10^{-5}$ Ω·cm. The barrier layer often has a thickness of 0.02 to 0.5 μm, especially 0.02 to 0.2 μm.

Also contemplated herein is a composite substrate comprising an electrode layer containing silver and a barrier layer containing a conductive inorganic compound stacked in order on an electrically insulating substrate.

DESCRIPTION OF THE PREFERRED EMBODIMENTS

Figure 1:
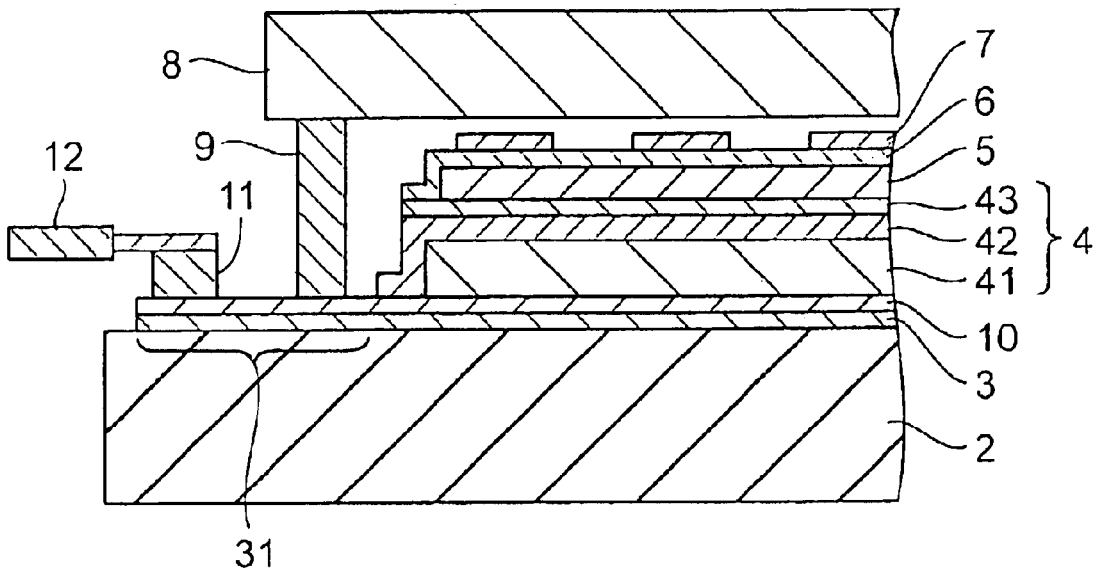
FIG. 1 is a cross-sectional view of a thin-film EL device according to one embodiment of the invention.

Referring to FIG. 1, there is illustrated one exemplary construction of the thin-film EL device of the invention. The thin-film EL device has an electrically insulating substrate 2 and includes a lower electrode layer 3, a lower insulating layer 4, a light emitting layer 5, an upper insulating layer 6, and an upper electrode layer 7 stacked in the described order on the substrate 2. The device further includes a barrier layer 10 between the lower electrode layer 3 and the lower insulting layer 4. The lower insulating layer 4 is a laminate of a thick-film dielectric layer 41, a surface smoothing layer 42 and a thin-film insulating layer 43.

Figure 2:
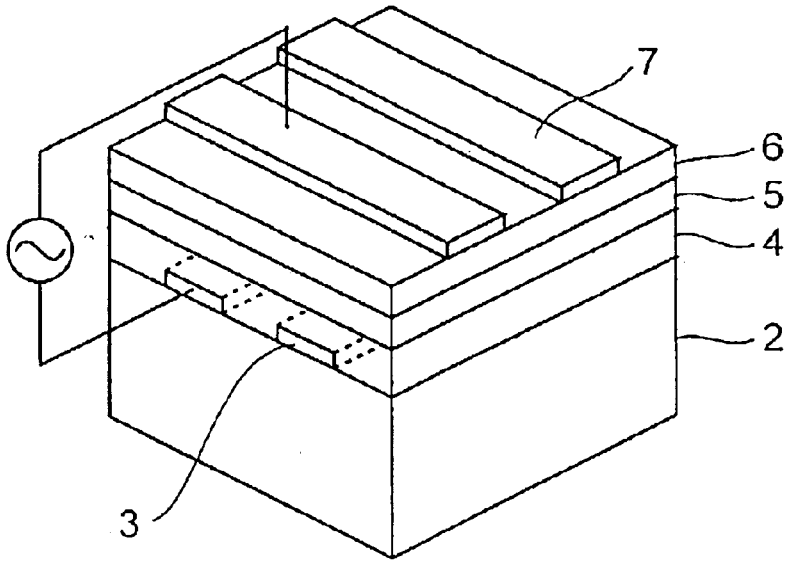
FIG. 2 is a perspective view of a thin-film EL device of the dual insulation structure.

In this EL device, the lower and upper electrode layers 3 and 7 are patterned in stripes and similarly driven as in the EL device illustrated in FIG. 2.

Although the thin-film EL device illustrated has the light emitting layer 5 of single layer structure, the invention is not limited thereto. It is applicable to a device of the structure wherein a plurality of light emitting layers are stacked in a thickness direction and also to a device of the structure wherein light emitting layer segments (or pixels) of different types are arranged in a planar matrix.

The main portion of the thin-film EL device is hermetically sealed with a panel face protective glass plate 8 and a seal 9 in order to protect the light emitting layer 5 from the ambient atmosphere, especially moisture.

The lower electrode layer 3 has an end portion serving as a lead 31 for electrical connection to the exterior. For instance, the lead 31 is electrically connected to a flexible printed board 12 via an anisotropic conductive resin layer 11 and then to an external drive circuit (not shown).

Now, the respective components of the inventive thin-film EL device are described in detail with reference to FIG. 1.

Barrier Layer 10

The present invention is characterized in that the barrier layer 10 containing a conductive inorganic material is disposed between the lower electrode layer 3 and the lower insulting layer 4.

Making extensive studies on the heat resistance of the lower electrode layer 3, especially the heat resistance of the lower electrode layer 3 when the lower insulating layer 4 lying thereon contains lead, we have come to the following conclusion.

Once a metal thin film is heated to a high temperature approximate to its melting point, the metal thin film agglomerates due to crystal grain growth of the metal and becomes a discontinuous film having an island structure, losing the electrode function. This phenomenon occurs at lower temperatures especially when the metal thin film is thin, or when the substrate on which the metal thin film is formed has asperities, whose size is not negligible relative to the thickness of the metal thin film, on its surface as in the case of alumina and other ceramic substrates.

Furthermore, Pb reacts with many noble metal elements including Au, Pt, Pd and Ag to form low-melting point alloys. When a dielectric material containing lead is deposited on a metal thin-film electrode containing such an element and converted into a thick-film insulating layer through a high-temperature heating process, the above-mentioned phenomenon occurs at a lower temperature, and especially, noticeable reaction with Ag occurs. This is presumably because Pb atoms liberated from lead oxide react with the metal thin-film electrode to induce the above-mentioned phenomenon at a lower temperature, resulting in the metal thin-film electrode suffering a substantial loss of heat resistance.

Furthermore, the above-mentioned phenomenon is more likely to occur if the substrate underlying the metal thin-film electrode contains $SiO_2$ or a similar material which is likely to form a low-melting point oxide with PbO. This is presumably because upon firing of the thick-film dielectric layer, the Pb component in the thick-film dielectric layer diffuses toward the substrate through defects in the metal thin-film electrode to form a low-melting point oxide within the substrate, and the low-melting point oxide thus formed interacts with the interface of the metal thin-film electrode on the substrate side. Since $SiO_2$ is frequently used, for example, as glass substrate materials, ceramic substrate materials such as forsterite ($2MgO{\bullet}SiO_2$), steatite ($MgO{\bullet}SiO_2$) and mullite ($3Al_2O_3{\bullet}2SiO_2$) or sintering aids for alumina ceramic substrates, the above-mentioned problem arises with almost all heat resistant insulating substrates.

Analyzing these phenomena, we have reached the structure that the barrier layer 10 containing a conductive inorganic compound is disposed in close contact with the lower electrode layer 3. Now that the barrier layer 10 which has a high melting point and is rigid as compared with the lower electrode layer 3 is formed on the lower electrode layer 3, the interaction at interface of the barrier layer 10 with the lower electrode layer 3 prevents the lower electrode layer 3 from an agglomeration phenomenon at high temperature.

When the lower electrode layer 3 contains Ag and the thick-film dielectric layer 41 contains lead, the provision of the barrier layer 10, which is least reactive with lead oxide and has an enhanced barrier effect against lead diffusion, prevents diffusion of lead oxide which can degrade the heat resistance of the lower electrode layer 3 during formation of the thick-film dielectric layer 41 and allows the lower electrode layer 3 to maintain its electrode function. Namely, the reactions between the materials of which the lower electrode layer 3 and the substrate 2 are made and the lead component in the dielectric material are prohibited, imparting higher heat resistance to the lower electrode layer 3.

The provision of the barrier layer 10 according to the invention is also effective for preventing the lower electrode layer 3 from sulfidation and oxidation. In this connection, one typical process of manufacturing the thin-film EL device of the invention is described. First, on the substrate 2, the lower electrode layer 3 and the barrier layer 10 are formed in a predetermined pattern by a lift-off technique or the like. Then the lower insulating layer 4 is formed in a predetermined pattern by a screen printing technique or the like. Next, the light emitting layer 5 and the upper insulating layer 6 are formed in a predetermined pattern by a vacuum evaporation or sputtering technique using a mask. Next, the upper electrode layer 7 is formed in a predetermined pattern by a lift-off technique or the like. When the lift-off technique is used in forming the lower electrode layer 3 and/or upper electrode layer 7 and ashing with an oxygen plasma is utilized in removing the resist residues, absent the barrier layer 10, the lead 31 which is the exposed portion of the lower electrode layer 3 is irradiated with the oxygen plasma. With oxygen plasma irradiation, the electrode, if it is Ag or an Ag alloy, can be oxidized to lower its conductivity, losing the electrode function. Also, when a technique of evaporation in a sulfur-containing gas such as hydrogen sulfide gas or sulfur vapor is employed in the formation of the light emitting layer 5 containing a sulfide, absent the barrier layer 10, the lead 31 is exposed to the sulfur-containing gas. The electrode, if it is Ag or an Ag alloy, can be sulfided with the sulfur-containing gas to lower its conductivity, losing the electrode function. Understandably, the provision of the barrier layer 10 covering the entire surface of the lower electrode layer 3 including the lead 31 prevents the lower electrode layer 3 from being damaged by oxidation, sulfidation or the like. There is a possibility that after the thin-film EL device has been fabricated, sulfur atoms in the light emitting layer 5 diffuse with the passage of time and eventually reach the lower electrode layer 3 to change the properties thereof. The barrier layer 10 can prevent this possibility. Therefore, the provision of the barrier layer 10 improves the reliability of the thin-film EL device.

The barrier layer 10 must be electrically conductive in order not to induce a capacitance drop in the lower insulating layer 4, but its conductivity may be low as compared with that of a single electrode because the lower electrode layer 3 is essentially responsible for the electrode function.

Now the electrical resistance required for the electrode of an EL display is discussed. Assume that row electrode strips have a width of 300 $\mu$m and a length of 20 cm, for example. The resistance of the row electrode which is 0.5 $\mu$m thick is about 27Ω when their resistivity is $2\times10^{-6}$ Ω·cm and about 267Ω when their resistivity is $2\times10^{-5}$ Ω·cm, the latter resistance being a non-negligible value. Therefore, the resistivity of the electrode should be up to $2\times10^{-5}$ Ω·cm, preferably up to $1\times10^{-5}$ Ω·cm.

However, since the electrode function is provided by the lower electrode layer 3 according to the invention, the barrier layer 10 may have any conductivity insofar as it does not induce a capacitance drop in the lower insulating layer 4 in contact with the lower electrode layer 3. Assume an example in which the barrier layer 10 is disposed between the lower insulating layer 4 having a permittivity of 2,000 and a thickness of 20 $\mu$m and the lower electrode layer 3. In the absence of the barrier layer 10, the lower insulating layer 4 has an impedance in thickness direction of $1/F\times1.8\times10^{6}\Omega/cm^{2}$ wherein F is a frequency. In the case of ordinary EL displays, the drive frequency of an EL device constituting an individual pixel usually does not exceed 30 kHz. It is thus recognized that the lower insulating layer 4 has an impedance of 60Ω or greater. The influence of the barrier layer 10 on the lower insulating layer 4 is regarded substantially negligible if the impedance of the barrier layer is up to 1% (0.6Ω) of the impedance of the lower insulating layer 4. Then, the barrier layer 10 may have a resistivity of up to 12,000 Ω·cm when it has a thickness of 0.5 $\mu$m, for example. In consideration of electric connection to the exterior via the laminate of the lower electrode layer 3 and the barrier layer 10, provided that a portion of the lead 31 of the lower electrode layer 3 which is used for connection to the exterior has an area (=area of anisotropic conductive resin layer 11) of 300 $\mu$m×1 mm, and the contact has a resistance of up to 1 Ω, the resistivity of the barrier layer 10 may be up to 60 Ω·cm. Accordingly, the resistivity of the barrier layer 10 is generally up to 100 Ω·cm, preferably up to 10 Ω·cm, though it also depends on the thickness.

As described above, the barrier layer 10 needs to have a function of improving the heat resistance of the lower electrode layer 3 and a relatively low resistivity. Further, when a lead-containing compound is used in the lower insulating layer 4, the barrier layer 10 should preferably have a barrier function to lead diffusion as well. Searching for conductive inorganic compounds that satisfy these requirements, we have found that oxides and/or nitrides having conductivity are effective, for example, oxides containing indium and/or tin, zinc oxide, aluminum-doped zinc oxide, titanium nitride, chromium nitride, zirconium nitride and hafnium nitride. Accordingly, the present invention requires a barrier layer containing at least one of these conductive inorganic compounds, preferably a barrier layer consisting essentially of at least one of these conductive inorganic compounds. Of these conductive inorganic compounds, oxides are preferred because they have satisfactory heat resistance in a high-temperature, oxidizing atmosphere, with oxides containing indium and/or tin being especially preferred. Such a barrier layer 10 is effective especially when combined with the lower electrode layer 3 containing Ag. When a lead-containing compound is used in the lower insulating layer 4, the use of oxides containing indium and/or tin as the conductive inorganic compound is especially effective.

The oxides containing indium and/or tin include indium oxide ($In_2O_3$), tin oxide ($SnO_2$) and indium tin oxide (ITO). These oxides are known, for example, as a material to construct a transparent electrode like the upper electrode layer 7. $In_2O_3$ and $SnO_2$ are regarded to be oxygen deficient N-type semiconductors. Their thin films are generally formed by sputtering or the like. It is known that when a thin film of oxide is used as an electrode layer, its resistivity can be reduced to a level of about $10^{-1}$ to $10^{-3}$ Ω·cm by controlling film depositing conditions so as to incorporate oxygen defects. The resistivity of this order is very high as compared with that of metal electrodes. In order to obtain a lower resistivity, $In_2O_3$ is used in a form doped with $SnO_2$, that is, ITO, and $SnO_2$ is used in a form doped with Sb or F. In these cases, the resistivity can be reduced to a level of about $10^{-3}$ to $10^{-4}$ Ω·cm.

However, it is known that these conductive oxides increase their resistivity when heat treated at a high temperature of at least 600° C. in an oxidizing atmosphere. For this reason, the use of these conductive oxides as a material for the lower electrode layer underlying the thick-film dielectric layer to be sintered through high-temperature treatment in an oxidizing atmosphere is difficult except for special cases such as the manufacture of very small-size displays.

In contrast, although it is preferred in the thin-film EL device of the invention that the barrier layer have a lower resistivity, this is not an essential requirement as discussed above. As a general rule, the barrier layer may have a resistivity of up to 100 Ω·cm, preferably up to 10 Ω·cm.

Therefore, even if the high-temperature treatment in an oxidizing atmosphere during formation of the thick-film dielectric layer entails degraded properties (increased resistivity), this is not a problem. Unlike the case of using such a layer alone as the electrode, the barrier layer can be used without introducing dopants or the like. On use of ITO, the $SnO_2$ content in ITO is not critical and may range from 0 to 100% by weight. It is noted that the $SnO_2$ content in ITO is preferably set to 1 to 20% by weight, more preferably 5 to 12% by weight, in order to reduce resistivity.

The composition of zinc oxide, titanium nitride, chromium nitride, zirconium nitride and hafnium nitride may be in accord with the stoichiometry or have an atomic ratio (metal/nitrogen, etc.) off the stoichiometry as long as they have the necessary conductivity.

For the purposes of acquiring satisfactory conductivity and eliminating reactivity with lead, it is preferred that the barrier layer do not contain any components other than the conductive compound. However, inclusion of other elements such as incidental impurities and trace additives is acceptable. The content of other elements should preferably be up to 10 atom % of the barrier layer.

If the barrier layer 10 is too thin, its effect of restraining the agglomeration phenomenon of the lower electrode layer 3 at high temperatures becomes insufficient and its barrier effect against lead diffusion and its effect of preventing sulfidation and oxidation of the lower electrode layer 3 become short. Particularly when ceramic and similar substrates having surface asperities are used as the substrate 2, the coverage of the lower electrode layer 3 with the barrier layer 10 becomes incomplete, undesirably permitting the lead base dielectric material to migrate from the thick-film dielectric layer 41 to the lower electrode layer 3 through pinholes and deficiencies in the barrier layer 10 to incur reaction with the lower electrode layer 3. We have empirically found that as long as the barrier layer 10 has a thickness of at least 0.02 $\mu$m, especially at least 0.1 $\mu$m, its barrier effect against lead diffusion and its effect of preventing sulfidation and oxidation become satisfactory.

On the other hand, if the barrier layer 10 is too thick, it is undesirable, especially for use in displays, for the following reason. Since the lower electrode layer 3 must be patterned in stripes and the barrier layer 10 must be similarly patterned in order to prevent short-circuiting, steps corresponding to the total thickness of the lower electrode layer 3 and the barrier layer 10 are formed at the edge of the pattern. The surface smoothness of any layer formed thereon is affected by these steps. Eventually, the EL panel has asperities on its surface due to the steps, substantially detracting from the display quality of the panel. Then, the total thickness of the lower electrode layer 3 and the barrier layer 10 is desired to be as thin as possible. Illustratively, the total thickness is preferably up to 2 $\mu$m, more preferably up to 1 $\mu$m, even more preferably up to 0.5 $\mu$m. Then, the thickness of the barrier layer 10 is preferably determined in consideration of the thickness of the lower electrode layer 3 such that the total thickness may fall within the range. The thickness of the lower electrode layer 3 is preferably at least 0.3 $\mu$m when its resistivity is taken into account. Also in the event where the substrate 2 has asperities on its surface as in the case of sintered alumina substrates, the lower electrode layer 3 may have very low heat resistance if it is thin, but such problems are unlikely to occur at a thickness of at least 0.3 $\mu$m.

To ensure sufficient conductivity for the above-described electrical connection to the exterior via the barrier layer 10, the barrier layer 10 should preferably be thin, and often have a thickness of up to 0.5 $\mu$m, especially up to 0.2 $\mu$m.

In forming the barrier layer 10, well-known methods of forming transparent conductive films may be used, for example, physical vapor deposition (PVD) methods such as ion plating and sputtering, solution coating-and-firing methods such as sol-gel and MOD, and spray pyrolysis methods.

The PVD methods are able to form high density thin films. This implies a possibility to form a barrier layer that exerts an enhanced barrier effect against lead diffusion and an enhanced effect of preventing oxidation and sulfidation at a reduced thickness. The PVD methods are thus preferred particularly when the barrier layer 10 is formed on the lower electrode layer 3 which has been formed on a flat substrate.

On the other hand, the solution coating-and-firing methods and spray pyrolysis methods are known as methods capable of forming transparent conductive films at low cost. Since the transparent conductive films formed by these methods have a resistivity which is higher by approximately one order than the resistivity of transparent conductive films formed by the PVD methods, they have heretofore been sometimes difficult to use as the electrode. However, as described above, the barrier layer 10 in the inventive thin-film EL device gives rise to no problem even if its resistivity is relatively high. Additionally, since these methods, especially the solution coating-and-firing methods are easy to form defect-free coatings on an underlay having asperities or steps, they are advantageously employed when the barrier layer 10 is formed on the lower electrode layer 3 which has been formed on a ceramic substrate having surface asperities.

Lower Electrode Layer 3

The material of the lower electrode layer 3 is selected from metals (including metalloids) or alloys thereof (including intermetallic compounds). It preferably has a high electric conductivity and should not be damaged by a high-temperature oxidizing atmosphere during formation of the thick-film dielectric layer 41. Preferred materials include high-melting point noble metals such as Pt, Pd and Ir, other noble metals such as Au and Ag, alloys of noble metals such as Au—Pd, Au—Pt, Ag—Pd and Ag—Pt, alloys of a noble metal(s) as the majority with a base metal such as Ag—Pd—Cu, and metal silicides such as titanium silicide.

The lower electrode layer 3 is reduced in electrode resistance and improved in heat resistance as its thickness increases. However, as described above, if the patterned lower electrode layer 3 is thick, undesirably it substantially compromises the image quality of a display. It is thus desired that the lower electrode layer 3 be as thin as possible. Increasing the thickness of the lower electrode layer 3 is also undesirable from the standpoints of film formation cost and material cost. Particularly when a noble metal with an increased material cost is used, a thickness increase directly entails an increased cost. In this regard too, it is desired that the lower electrode layer 3 be thinner.

In these regards, the lower electrode layer 3 preferably comprises Ag which gives a lower electrode resistance even at a reduced thickness and is far less expensive than the other noble metals. Great benefits would be obtained if the lower electrode layer 3 were composed of Ag alone.

In the thin-film EL device of the invention wherein the barrier layer 10 lies on the lower electrode layer 3, the lower electrode layer 3 is not converted to an island structure and maintains its uniform continuous structure during formation of the thick-film dielectric layer 41, even if the lower electrode layer 3 has a reduced thickness. In the embodiment where the barrier layer 10 comprises an oxide containing indium and/or tin, this barrier layer 10 has an enhanced barrier effect against lead diffusion, so that even when a lead base dielectric material is used in the thick-film dielectric layer 41, the lower electrode layer 3 may be composed of inexpensive metal materials such as pure Ag and Ag-containing materials which have heretofore been difficult to use because of high reactivity with lead oxide. Specifically, even when an electrode of pure Ag having the lowest melting point among the noble metals is used, the lower electrode layer 3 can have a thickness of up to 1 $\mu$m, and especially up to 0.5 $\mu$m. This is quite advantageous with respect to an improvement in image quality of a display using EL devices and a reduction of manufacturing cost. It is noted that since the metal silicide is also highly reactive with lead, the invention is highly effective with a metal silicide electrode if used.

Any desired method may be used in forming the lower electrode layer 3. A choice may be made among well-known methods including sputtering, evaporation, plating, and printing using organic metal paste (metallic resinate paste).

For the passive matrix type, the lower electrode layer 3 is formed in a stripe pattern consisting of a plurality of linear electrode strips. In this event, the width of each electrode strip becomes the width of a pixel while the space between two adjacent electrode strips becomes a non-light-emitting region. It is preferred to minimize the space between electrode strips. For example, an electrode strip width of about 200 to 500 $\mu$m and a space width of about 20 to 50 $\mu$m are necessary although the width varies depending on the desired resolution of the display.

Substrate 2

The substrate 2 is not critical as long as it is electrically insulating, does not contaminate the lower electrode layer 3 and thick-film dielectric layer 41 to be formed thereon, and maintains a predetermined temperature strength. The material of the substrate 2 can be selected from a wide range because in the inventive EL device, the lower electrode layer 3 can maintain heat resistance even when the substrate contains in its composition $SiO_2$, $B_2O_3$ or a compound which is highly reactive with lead oxide.

Illustrative materials include ceramic substrates of alumina ($Al_2O_3$), quartz glass ($SiO_2$), magnesia (MgO), forsterite ($2MgO{\bullet}SiO_2$), steatite ($MgO{\bullet}SiO_2$), mullite ($3Al_2O_3{\bullet}2SiO_2$), beryllia (BeO), zirconia ($ZrO_2$), aluminum nitride (AlN), silicon nitride (SiN), and silicon carbide (SiC) as well as crystallized glass, heat resistant glass or the like. Enamel-coated metal substrates can also be used.

Thick-Film Dielectric Layer 41

The lower insulating layer 4 should have a high permittivity (or dielectric constant) and high dielectric strength. The lower insulating layer 4 the majority of which is constructed by the thick-film dielectric layer 41 has a high permittivity which may become at least 100 times greater than when a thin-film dielectric layer is used.

The thick-film dielectric layer as used herein means a dielectric layer which is formed by the so-called thick-film technique, that is, a ceramic layer which is formed by firing a powder insulating material. The thick-film dielectric layer 41 may be formed, for example, by mixing a powder insulating material with a binder and a solvent to form an insulating paste, and printing the insulating paste onto the substrate 2 having the lower electrode layer 3 borne thereon, followed by firing. Alternatively, it may be formed by casting the insulating paste to form green sheets, and laying the green sheets on the substrate 2 having the lower electrode layer 3 borne thereon, followed by firing.

The material of which the thick-film dielectric layer 41 is made is not critical. Preferred materials used herein are, for example, perovskite structure dielectric and ferroelectric materials such as $BaTiO_3$, $(Ba_xCa_{1-x})TiO_3$, $(Ba_xSr_{1-x})TiO_3$, $PbTiO_3$ and $Pb(Zr_xTi_{1-x})O_3$ known as PZT, complex perovskite relaxation type ferroelectric materials as typified by $Pb(Mg_{1/3}Nb_{2/3})O_3$, bismuth layer compounds as typified by $Bi_4Ti_3O_{12}$ and $SrBi_2Ta_2O_9$, and tungsten bronze type ferroelectric materials as typified by $(Sr_xBa_{1-x})Nb_2O_6$ and $PbNb_2O_6$. Of these, perovskite structure ferroelectric materials such as $BaTiO_3$ and PZT are preferred for high permittivity and ease of firing.

In particular, dielectric materials containing lead in their composition are preferred in that they are readily sinterable at low temperatures because the melting point of lead oxide is as low as 888° C. and a liquid phase is formed at low temperatures of about 700 to 800° C. between lead oxide and another oxide base material such as $SiO_2$, CuO, $Bi_2O_3$ or $Fe_2O_3$, and because a high permittivity is readily available. Preferred lead-containing dielectric materials include, for example, perovskite structure dielectric materials such as PZT and PLZT ($PbZrO_3$—$PbTiO_3$ solid solution with La added), complex perovskite relaxation type ferroelectric materials as typified by $Pb(Mg_{1/3}Nb_{2/3})O_3$, and tungsten bronze type ferroelectric materials as typified by $PbNb_2O_6$. Of these, lead-containing complex perovskite relaxation type ferroelectric materials as typified by $Pb(Mg_{1/3}Nb_{2/3})O_3$ are preferred because a dielectric layer having a relative permittivity of 1,000 to 10,000 can be readily formed therefrom by firing at a temperature of 700 to 900° C.

The thick-film dielectric layer 41 should desirably have a sufficient thickness to smooth out steps of the electrode and pinholes formed by debris or dust during the manufacturing process, specifically a thickness of at least 10 $\mu$m, preferably at least 20 $\mu$m. Notably, the total thickness of the thick-film dielectric layer 41 and the surface smoothing layer 42 should preferably be 100 $\mu$m or less in order to prevent any rise of light emission threshold voltage.

Surface Smoothing Layer 42

The surface smoothing layer 42 is provided for the purpose of mitigating the degradation of the surface smoothness of the lower insulating layer 4 by surface irregularities of the thick-film dielectric layer 41. A solution coating-and-firing technique must be used to form the surface smoothing layer 42.

The solution coating-and-firing technique as used herein encompasses techniques of applying a precursor solution of dielectric material to a substrate, followed by firing to form a dielectric layer, such as sol-gel technique and metallo-organic decomposition (MOD) technique.

The sol-gel technique is generally a technique of adding an amount of water to a metal alkoxide in a solvent, effecting hydrolysis and polycondensation to form a sol precursor solution having M-O-M bonds, applying the precursor solution to a substrate, and firing to form a film. The MOD technique is a technique of dissolving a metal salt of carboxylic acid having M-O bonds in an organic solvent to form a precursor solution, applying the precursor solution to a substrate, and firing to form a film. The precursor solution designates a solution containing intermediate compounds that form when starting compounds are dissolved in a solvent, in the sol-gel, MOD and other film forming techniques.

The sol-gel and MOD techniques are not completely separate techniques, but are generally used in combination. For example, when a film of PZT is formed, it is a common practice to prepare a solution using lead acetate as the Pb source and alkoxides as the Ti and Zr sources. Sometimes, both the sol-gel and MOD techniques are generally referred to as sol-gel technique. Since a film is formed in either case by applying a precursor solution to a substrate followed by firing, the relevant technique is referred herein as the "solution coating-and-firing technique." A solution obtained by mixing dielectric particles of submicron size with a dielectric precursor solution is encompassed within the concept of the dielectric precursor solution as used in the present invention, and a procedure of applying that solution to a substrate followed by firing is also encompassed within the concept of the solution coating-and-firing technique as used in the present invention.

The solution coating-and-firing technique in which compounds constituting the dielectric are intimately mixed on an order of submicron or less, independent of whether it is the sol-gel or MOD technique, is characterized by a possibility to synthesize dense dielectrics at very low temperatures, as compared with the techniques essentially relying on ceramic powder sintering as in the formation of dielectric by the thick-film technique. The solution coating-and-firing technique is used for the following major reason. Since the dielectric layer is formed by way of the steps of applying a precursor solution and firing, it is formed thick in recesses of the underlay and thin on protrusions of the underlay. As a consequent, the surface of this coating does not reflect surface asperities or steps of the underlay, becoming a film having a flat surface. Therefore, when the surface smoothing layer 42 is formed by the solution coating-and-firing technique, the surface smoothness of the lower insulating layer 4 does not reflect the surface roughness of the thick-film dielectric layer 41, contributing to a significant improvement in uniformity of the light emitting layer 5 to be formed on the lower insulating layer 4.

The thickness of the surface smoothing layer 42 may be determined so as to fully smooth out surface asperities of the thick-film dielectric layer 41 and is usually at least 0.5 $\mu$m, preferably at least 1 $\mu$m, more preferably at least 2 $\mu$m. The thickness of the surface smoothing layer 42 need not exceed 10 $\mu$m if its main purpose is to smooth out surface asperities of the thick-film dielectric layer 41.

The surface smoothing layer 42 should desirably have a higher relative permittivity, preferably at least 100, more preferably at least 500. Useful dielectric materials having such a high permittivity include perovskite structure dielectric and ferroelectric materials such as $BaTiO_3$, $(Ba_xCa_{1-x})TiO_3$, $(Ba_xSr_{1-x})TiO_3$, $PbTiO_3$, PZT and PLZT, complex perovskite relaxation type ferroelectric materials as typified by $Pb(Mg_{1/3}Nb_{2/3})O_3$, bismuth layer compounds as typified by $Bi_4Ti_3O_{12}$ and $SrBi_2Ta_2O_9$, and tungsten bronze type ferroelectric materials as typified by $(Sr_xBa_{1-x})Nb_2O_6$ and $PbNb_2O_6$. Of these, ferroelectric materials containing lead oxide in their basic composition, specifically lead base complex perovskite structure ferroelectric materials such as PZT and PLZT are preferred because they have a high permittivity and are easy to fire at relatively low temperatures below 700° C.

Although the construction illustrated in FIG. 1 includes a laminate of the surface smoothing layer 42 formed by the solution coating-and-firing technique on the thick-film dielectric layer 41, it is acceptable in the inventive EL device to eliminate the thick-film dielectric layer and to form only a dielectric layer by the solution coating-and-firing technique. Since the solution coating-and-firing technique involves a heating step in an oxidizing atmosphere as does the thick film technique, the effects associated with the provision of the barrier layer are still achieved when only the dielectric layer by the solution coating-and-firing technique is provided.

Thin-Film Insulating Layer 43 and Upper Insulating Layer 6

The provision of the thin-film insulating layer 43 and the upper insulating layer 6 sandwiching the light emitting layer 5 is not essential, but preferable.

The provision of these insulating layers enables to control the electronic state at the interface between these insulating layers and the light emitting layer 5 for rendering stable and efficient the injection of electrons into the light emitting layer 5. On account of the symmetric provision of these insulating layers on opposite sides of the light emitting layer 5 at the center, the electronic state is made symmetric at the opposite interfaces of the light emitting layer 5, leading to an improvement in the positive/negative symmetry of light emission upon AC driving. These insulating layers may be thin because they need not have a function of holding dielectric strength. They preferably have a thickness of about 10 to 1,000 nm, more preferably about 20 to 200 nm.

The insulating layers preferably have a resistivity of at least $10^8$ Ω·cm, especially about $10^{10}$ to $10^{18}$ Ω·cm. A material having a relatively high relative permittivity as well is preferred. The relative permittivity is preferably at least 3. The materials of which the insulating layers are made include, for example, silicon oxide ($SiO_2$), silicon nitride (SiN), tantalum oxide ($Ta_2O_5$), yttrium oxide ($Y_2O_3$), zirconia ($ZrO_2$), silicon oxynitride (SiON), alumina ($Al_2O_3$), etc. In forming the insulating layers, sputtering, evaporation, and CVD techniques may be used.

Light Emitting Layer 5

The benefits of the invention are achievable independent of the material of which the light emitting layer 5 is made. Therefore, the light emitting material of which the light emitting layer 5 is made is not critical and any of the aforementioned phosphor materials such as Mn-doped ZnS may be used. The thickness of the light emitting layer is not critical. However, too thick a layer requires an increased drive voltage whereas too thin a layer results in a low emission efficiency. Illustratively, the light emitting layer is preferably about 100 to 2,000 nm thick, although the thickness varies depending on the identity of the emissive material.

In forming the light emitting layer 5, any vapor phase deposition technique may be used. The preferred vapor phase deposition techniques include physical vapor deposition (PVD) such as sputtering or evaporation, and chemical vapor deposition (CVD). Also, when a light emitting layer of SrS:Ce is formed in a $H_2S$ atmosphere at a substrate temperature of 500 to 600° C. by an electron beam evaporation technique, the resulting light emitting layer can be of high purity.

Following the formation of the light emitting layer 5, it is preferably annealed. Annealing may be conducted on the light emitting layer 5 in exposed state or cap annealing may be conducted after the formation of the upper insulating layer 6 on the light emitting layer 5 or after the further formation of the upper electrode layer 7 thereon. The optimum annealing temperature varies with a particular material of the light emitting layer. For SrS:Ce, the annealing temperature is preferably at least 500° C., more preferably at least 600° C., and below the firing temperature of the thick-film dielectric layer 41, and the treating time is preferably 10 to 600 minutes. Annealing is preferably conducted in an Ar atmosphere.

Upper Electrode Layer 7

In the inventive thin-film EL device wherein the emitted light emerges from the side of the upper electrode layer 7, the upper electrode layer 7 is made of a transparent conductive material. Suitable transparent conductive materials include $In_2O_3$, $SnO_2$ and ITO as used in the barrier layer 10 and oxide conductive materials such as ZnO—Al. The upper electrode layer 7 may be formed by well-known techniques such as sputtering and evaporation. The thickness of the upper electrode layer 7 may be 0.2 to 1 $\mu$m.

EXAMPLE

Examples of the invention are given below by way of illustration and not by way of limitation.

Example 1

In accordance with the construction illustrated in FIG. 1, test samples were prepared by forming on the substrate 2 a series of layers stacking up to the thick-film dielectric layer 41 by the following procedures.

The substrate 2 used was an alumina substrate of 96% purity (containing 4% of $SiO_2$/MgO as sintering aids) or a high strain point heat resistant glass substrate (softening point 850° C.), both commercially available. On the substrate 2, a positive resist was coated to form a resist film for lift-off patterning.

Then, an Ag thin film or Au thin film was formed as the lower electrode layer 3. An ITO thin film or $SnO_2$ thin film was then formed as the barrier layer 10. As a comparative example, a sample without the barrier layer 10 was prepared. The composition of the lower electrode layer 3 and the barrier layer 10 is shown in Table 1. The thin films were formed under the following conditions.

The Ag or Au thin film was formed by using a magnetron sputtering equipment with Ag as the target, under conditions including an Ar gas atmosphere having a pressure of 0.5 Pa, a frequency of 13.56 MHz and an RF power density of 3 W/cm$^2$. The rate of film deposition was about 50 nm/min for the Ag thin film and about 33 nm/min for the Au thin film. By adjusting the sputtering time, the film was formed to the thickness shown in Table 1. The resistivity was about $2\times10^{-6}$ Ω·cm for the Ag thin film and about $3\times10^{-6}$ Ω·cm for the Au thin film.

The ITO thin film was formed by using a magnetron sputtering equipment with ITO ($SnO_2$ 10 wt %) ceramic as the target, under conditions including an Ar gas atmosphere having a pressure of 1 Pa, a frequency of 13.56 MHz and an RF power density of 4 W/cm$^2$. The rate of film deposition was about 15 nm/min. By adjusting the sputtering time, the film was formed to the thickness shown in Table 1. The ITO thin film had a resistivity of about $10^{-3}$ Ω·cm. The $SnO_2$ thin film was formed by using a magnetron sputtering equipment with an alloy of Sn+1% Sb as the target, under conditions including an Ar+$O_2$ (20%) gas atmosphere having a pressure of 1 Pa, a frequency of 13.56 MHz and an RF power density of 4 W/cm$^2$. The rate of film deposition was about 30 nm/min. By adjusting the sputtering time, the film was formed to the thickness shown in Table 1. The $SnO_2$ thin film had a resistivity of about $10^{-2}$ Ω·cm.

Next, the unnecessary portions of the lower electrode layer 3 and barrier layer 10 were peeled by the lift-off technique, resulting in the electrode layer having a stripe pattern including a plurality of electrode strips having planar dimensions of 1 mm×50 mm.

Next, using a thick-film dielectric paste 4210C (by ESL), the thick-film dielectric layer 41 was formed on the substrate 2 having the barrier layer 10 stacked thereon, by a screen printing technique. The thick-film dielectric paste is based on a $Pb(Mg_{1/3}Nb_{2/3})O_3$ base perovskite dielectric composition and contains excess lead oxide as sintering aid. In the screen printing process, steps of coating and drying were repeated until the total thickness of coatings reached 20 $\mu$m when fired. It is noted that for resistance measurement, opposite 5-mm regions of the barrier layer strip were left exposed without coating the paste. At the end of formation, the coating was fired at a temperature of 650 to 800° C. for 30 minutes in a belt furnace in an atmosphere of full air supply. The firing temperature for each sample is shown in Table 1.

For each sample, the electric resistance of the laminate consisting of the lower electrode layer 3 and the barrier layer 10 was measured. This electric resistance is reported as electrode resistance in Table 1. It is noted that the electrode resistance reported in Table 1 is a relative value based on an electrode resistance of 1 for each sample prior to the formation of the thick-film dielectric layer 41.

TABLE 1

| | Lower insulating layer: lead base dielectric | | | | | | |
|---|---|---|---|---|---|---|---|
| | Composition of conductive layer/lower electrode layer | Thickness of conductive layer/lower electrode layer | Electrode resistance (relative value) | | | | |
| | | | 96% alumina substrate | | | | Glass substrate |
| | | | 650° C. | 700° C. | 750° C. | 800° C. | 650° C. |
| Invention | ITO/Ag | 500 nm/500 nm | 1.10 | 1.40 | 1.94 | 2.10 | 1.02 |
| | ITO/Ag | 200 nm/500 nm | 1.32 | 1.41 | 1.90 | 2.05 | 1.01 |
| | ITO/Ag | 100 nm/500 nm | 1.41 | 1.57 | 2.15 | 2.40 | 1.04 |
| | ITO/Ag | 25 nm/500 nm | 1.56 | 1.80 | 2.21 | 3.45 | 1.09 |
| | $SnO_2$/Ag | 500 nm/500 nm | 1.15 | 1.38 | 1.86 | 2.70 | 1.02 |
| | ITO/Au | 500 nm/500 nm | 1.10 | 1.12 | 1.22 | 1.25 | 1.00 |
| Comparison | –/Ag | –/500 nm | break | break | break | break | break |
| | –/Au | –/500 nm | 1.10 | 1.27 | 5.85 | break | 1.10 |

The effectiveness of the invention is evident from Table 1. Specifically, in the event where the barrier layer 10 in the form of an ITO thin film of 500 nm thick is formed over the lower electrode layer 3 in the form of an Ag thin film of 500 nm thick, the lower electrode layer 3 experiences a resistance increase within only about two folds even when the thick-film dielectric layer 41 is formed at a firing temperature as high as 800° C. That is, the lower electrode layer 3 fully maintains an electrode function. Better results are obtained when the lower electrode layer 3 is made of Au. The barrier layer 10 in the form of a $SnO_2$ thin film exhibits equivalent properties to the ITO thin film.

By contrast, when the Ag electrode was used alone without the barrier layer 10, the electrode broke at a firing temperature of 650° C. or higher, losing the electrode function. Also, when the Au electrode was used alone, the electrode broke at a firing temperature of 800° C., losing the electrode function.

The sample in which the ITO thin film has a thickness of 25 nm experiences a great resistance change as compared with a thickness of 500 nm, but is devoid of break. The reason why a greater resistance change occurs when the barrier layer 10 becomes thin is as follows. The surface of the substrate 2 has noticeable asperities because it is the surface of alumina ceramics as fired. When the barrier layer 10 formed on such a substrate 2 via the lower electrode layer 3 is thin, the step coverage during sputtering becomes insufficient and so, the surface of the lower electrode layer 3 is locally left uncovered with the barrier layer 10.

Example 2

Test samples were prepared as in Example 1 except that the alumina substrate 2 in Example 1 was used and the thick-film dielectric layer 41 was composed of barium titanate ($BaTiO_3$). The firing temperature during formation of the thick-film dielectric layer 41 was 900° C. The test samples were examined as in Example 1, with the results shown in Table 2.

TABLE 2

| | Lower insulating layer: barium titanate | | |
|---|---|---|---|
| | Composition of conductive layer/lower electrode layer | Thickness of conductive layer/lower electrode layer | Electrode resistance (relative value) 96% alumina substrate 900° C. |
| Invention | ITO/Ag | 200 nm/500 nm | 1.05 |
| | ITO/Ag | 100 nm/500 nm | 1.05 |
| | ITO/Ag | 25 nm/500 nm | 1.10 |
| | $SnO_2$/Ag | 200 nm/500 nm | 1.05 |
| | ITO/Au | 200 nm/500 nm | 1.03 |
| Comparison | —/Ag | —/500 nm | break |
| | —/Au | —/500 nm | break |

As is evident from Table 2, the barrier layer 10 is effective even when the lower insulating layer 4 does not contain a lead base compound.

Notably, the barrier layer (ITO) increased its resistivity to 100 Ω·cm because of heating at 900° C. during formation of the thick-film dielectric layer 41. However, as shown in Table 2, the barrier layer is fully effective even when it is thin (even at a thickness of 200 nm). The electric resistance of the barrier layer in a thickness direction is within the permissible range as long as its thickness is of this order.

Example 3

EL devices of the construction illustrated in FIG. 1 were prepared by the following procedure. Note that the thin-film insulating layer 43 was omitted.

First, as in Example 1, the lower electrode layer 3, barrier layer 10 and thick-film dielectric layer 41 were formed on the substrate 2 of alumina. The lower electrode layer 3 consisted of electrode strips having planar dimensions of 1 mm×100 mm. The firing of the thick-film dielectric layer 41 was conducted at 750° C. for 20 minutes. The thick-film dielectric layer 41 has a permittivity of about 2,500. The composition of the lower electrode layer 3 and barrier layer 10 are shown in Table 3.

Next, the surface smoothing layer 42 was formed using a solution coating-and-firing technique. In the solution coating-and-firing technique, a sol-gel solution of PZT (prepared by the following procedure) was used as a precursor solution. The steps of applying the precursor solution to the surface of the thick-film dielectric layer 41 by spin coating and firing the coating at 700° C. for 10 minutes were repeated until the surface smoothing layer 42 was formed to a thickness of about 3 μm.

The precursor solution was prepared by combining 8.49 g of lead acetate trihydrate and 4.17 g of 1,3-propane diol and heat mixing for about 2 hours to form a clear solution. Separately, 3.70 g of a 70 wt % 1-propanol solution of zirconium n-propoxide and 1.58 g of acetyl acetone were heated and stirred in a dry nitrogen atmosphere for 30 minutes, and 3.14 g of a 75 wt % 2-propanol solution of titanium diisopropoxide bisacetyl acetonate and 2.32 g of 1,3-propane diol were added to the solution, which was heated and stirred for 2 hours. These two solutions were mixed at 80° C., heated and stirred in a dry nitrogen atmosphere for 2 hours, obtaining a brown clear solution. The solution was held at 130° C. for several minutes to remove by-products, and heated and stirred for a further 3 hours, yielding a precursor solution. The precursor solution was adjusted to an appropriate viscosity by diluting it with n-propanol.

Next, with the substrate heated at 200° C., a ZnS:Mn layer of 0.8 μm thick was formed as the light emitting layer 5 by evaporating a Mn-doped ZnS source. This was followed by heat treatment in vacuum at 500° C. for 10 minutes.

Next, a $Si_3N_4$ thin film as the upper insulating layer 6 and an ITO thin film as the upper electrode layer 7 were successively formed, both by sputtering, yielding thin-film EL device samples. Using a metal mask during deposition, the upper electrode layer 7 was patterned in stripes, that is, electrode strips of 1 mm wide.

While electrodes were led out of the lower electrode layer 3 and the upper electrode layer 7, the device sample was operated by applying an electric field at a frequency of 1 kHz, a pulse width of 50 μs and a sufficient strength to saturate the luminance of light emission. The saturated luminance and the uniformity of light emission in the plane of the emissive surface were examined, with the results shown in Table 3.

TABLE 3

| | Lower insulating layer: lead base dielectric | | | |
|---|---|---|---|---|
| | Composition of conductive layer/lower electrode layer | Thickness of conductive layer/lower electrode layer | Luminance | Emission uniformity |
| Invention | ITO/Ag | 500 nm/500 nm | 6900 cd/m$^2$ | good |
| | $SnO_2$/Ag | 500 nm/500 nm | 5800 cd/m$^2$ | good |
| | ITO/Au | 500 nm/500 nm | 7200 cd/m$^2$ | good |
| Comparison | —/Ag | —/500 nm | no emission | — |
| | —/Au | —/500 nm | 6800 cd/m$^2$ | slightly varied |

As is evident from Table 3, the inventive samples having the structure that the barrier layer 10 overlies the lower electrode layer 3 exhibit a high luminance and uniform light emitting properties.

By contrast, the comparative sample in which the barrier layer was omitted and the lower electrode layer 3 was an Ag thin film did not emit light. This is presumably because the lower electrode layer 3 broke during the firing of the thick-film dielectric layer 41, losing the electrode function.

The other comparative sample in which the barrier layer was omitted and the lower electrode layer 3 was an Au thin film exhibited a saturated luminance substantially equal to that of the inventive samples, but the emissive surface lacked uniformity even on visual observation. When the surface was observed to the order of several tens of microns under an optical microscope, there were present regions of weak and strong emission intensities. This non-uniformity arises presumably because the Au thin film is short of heat resistance due to the absence of the barrier layer and partially loses the electrode function and because partial reaction takes place between the $SiO_2$ base sintering aid in the alumina substrate 2 and the lead base thick-film dielectric layer 41 during the firing of the thick-film dielectric layer 41 so that the properties of the thick-film dielectric layer 41 have a distribution.

Example 4

A comparative EL device sample No. 1 was prepared by the same procedure as in Example 3 except that the lower electrode layer 3 was formed of Ag, and the patterning of the lower electrode layer 3 by a lift-off technique utilized ashing with an oxygen plasma for removal of resist residues. In this comparative sample No. 1, the lower electrode layer 3 of Ag was oxidized and blackened by the oxygen plasma in the lift-off step and as a result, reduced its surface conductivity and lost the function of electrode-forming material.

A comparative sample No. 2 was prepared by the same procedure as comparative sample No. 1 except that the ashing with an oxygen plasma was omitted upon formation of the lower electrode layer 3, and the light emitting layer 5 was a SrS:Ce layer formed by evaporation in a $H_2S$ gas atmosphere. In this comparative sample No. 1, the lead 31 of the lower electrode layer 3 of Ag was sulfided and blackened with the $H_2S$ gas during formation of the light emitting layer 5 and as a result, reduced its surface conductivity and lost the function of electrode-forming material.

An inventive sample No. 3 was prepared by the same procedure as comparative sample No. 2 except that the entire surface of the lower electrode layer 3 was covered with the barrier layer 10 of ITO having a thickness of 100 nm, and the formation of the lower electrode layer 3 utilized ashing with an oxygen plasma. In this inventive sample No. 3, the lead 31 of the lower electrode layer 3 was not oxidized or sulfided with the oxygen plasma or $H_2S$ gas because it was covered with the barrier layer 10.

BENEFITS OF THE INVENTION

In prior art thin-film EL devices, the lower electrode layer containing expensive noble metal must be thick because the lower electrode layer, if thin, becomes a discontinuous film of island structure under the heat applied during formation of the lower insulating layer thereon by a thick-film technique. This not only increases the material cost, but also substantially detracts from display quality because larger steps appear at the EL panel surface as a consequence of pattern edges of the lower electrode layer.

In contrast, in the thin-film EL device of the invention wherein the barrier layer lies on the lower electrode layer, the lower electrode layer is unlikely to change to an island structure under the heat applied during formation of the lower insulating layer thereon by a thick-film technique or solution coating-and-firing technique. Therefore, the lower electrode layer in the inventive device can be thin, achieving a reduction of material cost and an improvement in display quality.

A dielectric material containing lead oxide is a superior material for forming the lower insulating layer since it is able to be fired at a low temperature and has a high permittivity. Pure Ag or metal materials containing Ag are appropriate materials for forming the lower electrode layer since they are highly conductive so that the electrode layer can be thin and their material cost is low. However, on account of high reactivity of Ag with lead oxide, reaction can take place between lead oxide in the lower insulating layer and Ag in the lower electrode layer during formation of the lower insulating layer, causing a resistance increase or failure of the lower electrode layer.

In contrast, the barrier layer formed according to the invention has an enhanced barrier effect against lead diffusion. Therefore, the invention permits the lower insulating layer containing a lead base dielectric to be combined with the lower electrode layer containing an Ag base material, and enables to fabricate an EL device having excellent light emitting properties and improved display quality at a low cost. The barrier layer is also effective for preventing oxidation and sulfidation of the lower electrode layer of Ag base material.

The composite substrate comprising an electrode layer and a barrier layer formed on a substrate as are the lower electrode layer and barrier layer in the inventive EL device is useful not only for EL devices, but also for other various display devices. Since the electrode layer in the composite substrate is fully heat resistant, the same benefits as achieved with the EL device are obtainable when layers which need heating during and/or after their formation are provided on the electrode layer.

Japanese Patent Application No. 2002-107562 is incorporated herein by reference.

What is claimed is:

1. A thin-film EL device comprising at least a lower electrode layer, a barrier layer containing a conductive inorganic compound, a lower insulating layer, a light emitting layer, and an upper electrode layer stacked in order on an electrically insulating substrate.

2. The thin-film EL device of claim 1 wherein the conductive inorganic compound is an oxide.

3. The thin-film EL device of claim 1 wherein the conductive inorganic compound is an oxide containing indium or tin or both.

4. The thin-film EL device of claim 1 wherein the lower electrode layer contains silver.

5. The thin-film EL device of claim 1 wherein the lower insulating layer comprises a lead-containing oxide dielectric.

6. A composite substrate comprising a silver-containing electrode layer and a barrier layer containing a conductive inorganic compound stacked in order on an electrically insulating substrate.

* * * * *